US010156409B1

(12) United States Patent
Laney et al.

(10) Patent No.: US 10,156,409 B1
(45) Date of Patent: Dec. 18, 2018

(54) TRIGGER MECHANISM FOR FIREARM

(71) Applicant: Smith & Wesson Corp., Springfield, MA (US)

(72) Inventors: Mark C. Laney, Lee, NH (US); Karl K. Ricker, Rochester, NH (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 15/794,346

(22) Filed: Oct. 26, 2017

(51) Int. Cl.
*F41A 19/10* (2006.01)
*F41A 17/46* (2006.01)
*F41A 19/12* (2006.01)

(52) U.S. Cl.
CPC ..... *F41A 19/10* (2013.01); *F41A 17/46* (2013.01); *F41A 19/12* (2013.01)

(58) Field of Classification Search
CPC ..... F41A 19/10; F41A 19/12; F41A 17/46
USPC ..... 42/69.01, 70.04, 70.05
See application file for complete search history.

(56) References Cited

U.S. PATENT DOCUMENTS 215,695 A * 5/1879 Toepperwein ..... F41A 19/10 42/69.01
290,737 A * 12/1883 Brown ..... F41A 3/10 42/23
698,440 A * 4/1902 Brown ..... F41A 19/10 42/69.01
1,285,885 A * 11/1918 Younger ..... F41A 19/10 42/69.01
2,090,656 A 8/1937 Williams
2,174,851 A 10/1939 Williams
4,449,313 A * 5/1984 Hackett ..... F41A 19/10 42/69.01
5,105,569 A 4/1992 Straitiff
6,354,032 B1 * 3/2002 Viani ..... F41A 19/10 42/42.03
6,553,706 B1 * 4/2003 Gancarz ..... F41A 17/46 42/69.02
6,571,501 B1 * 6/2003 Jennings ..... F41A 3/66 42/70.02
6,843,013 B2 1/2005 Cutini et al.
8,539,707 B1 * 9/2013 Di Trolio ..... F41A 15/16 42/25
8,572,878 B2 * 11/2013 Gentilini ..... F41A 17/72 42/69.01
9,046,313 B1 * 6/2015 Lutton ..... F41A 17/46
9,062,925 B1 * 6/2015 Viani ..... F41A 19/06
2003/0213159 A1 * 11/2003 Cutini ..... F41A 17/46 42/70.06
2006/0236581 A1 * 10/2006 Viani ..... F41A 19/30 42/69.01
2010/0024273 A1 * 2/2010 Duperry ..... F41A 19/10 42/69.01

(Continued)

*Primary Examiner* — Joshua E Freeman
(74) *Attorney, Agent, or Firm* — John A. Chionchio, Esquire; Ballard Spahr LLP

(57) ABSTRACT

A trigger mechanism has a first trigger which engages a sear connector and a second trigger, pivotably mounted on the first trigger, which supports the sear connector. The sear connector supports a sear, which holds a firing pin in the cocked position via a cocking piece. To discharge the firearm both triggers must be pulled. A safety lever has a hook which engages the second trigger and a projection which engages a spur on the first trigger when the lever is in the safe position.

23 Claims, 7 Drawing Sheets

(56) References Cited

U.S. PATENT DOCUMENTS

| | | | | |
|---|---|---|---|---|
| 2011/0072705 | A1* | 3/2011 | Simpkins | B25F 1/04 42/59 |
| 2013/0174460 | A1* | 7/2013 | Aigner | F41A 19/12 42/69.01 |
| 2015/0153125 | A1* | 6/2015 | Lutton | F41A 17/46 42/69.01 |
| 2015/0292828 | A1* | 10/2015 | Nebeker | F41A 17/72 42/69.01 |
| 2015/0330734 | A1 | 11/2015 | Kolev et al. | |
| 2016/0187092 | A1* | 6/2016 | Mather | F41A 19/10 42/69.02 |
| 2017/0059266 | A1* | 3/2017 | Gentilini | F41A 17/72 |
| 2018/0094891 | A1* | 4/2018 | Geissele | F41A 17/46 |
| 2018/0238651 | A1* | 8/2018 | Kilic | F41A 17/46 |

* cited by examiner

TRIGGER MECHANISM FOR FIREARM

FIELD OF THE INVENTION

This invention relates to trigger mechanisms for firearms.

BACKGROUND

Light trigger pulls on firearms, particularly rifles, are advantageous because they permit a skilled marksman to shoot more accurately. However, rifles having a trigger mechanism with a light trigger pull are sensitive to shocks and thus more susceptible to drop fires. Drop fires occur when the firearm, in the condition of maximum readiness (manual safety off, action cocked, live cartridge chambered), is dropped. Upon impact of the firearm with the ground or other unforgiving surface, inertial forces (shock) experienced by the trigger mechanism may cause it to release and discharge the firearm. The tendency to drop fire increases with lower trigger pull, i.e., drop fires will occur more frequently and at lower drop heights. There is clearly an opportunity to improve the safety of firearms while also retaining the improved accuracy of a light trigger pull.

SUMMARY

The invention concerns a trigger mechanism for a firearm. In an example embodiment, the trigger mechanism comprises a first trigger pivotable about a first trigger axis. The first trigger has an action surface positioned distal to the first trigger axis. A sear connector is pivotable about a sear connector axis. The sear connector has an engagement surface positioned distal to the sear connector axis. The action surface is engageable with the engagement surface to prevent pivoting motion of the sear connector. A sear is pivotable about a sear axis. The sear has a contact surface engageable with a first side of the sear connector between the engagement surface and the sear connector axis. A second trigger is pivotable about a second trigger axis extending through the first trigger. The second trigger has a lobe distal to the second trigger axis. The lobe is engageable with a second side of the sear connector arranged opposite to the first side and between the engagement surface and the sear connector axis to prevent pivoting motion of the sear connector. Pivoting motion of the second trigger through a predetermined angle causes the lobe to disengage from the second side of the sear connector, thereby allowing the sear connector to pivot when the first trigger is pivoted to disengage the action surface from the engagement surface, thereby permitting the sear to pivot about the sear axis.

In an example embodiment, the second side of the sear connector has a concave surface. The concave surface may have a radius of curvature equal to a distance of the lobe from the second trigger axis and the second trigger axis is coincident with a center of curvature of the concave surface.

An example mechanism may further comprise a spur extending from the first trigger. A safety lever is mounted adjacent to the first trigger and pivotable about a lever axis. A projection extends from the safety lever and is positioned distal to the lever axis. The projection is engageable with the spur to prevent pivoting motion of the first trigger. Pivoting of the safety lever through a first predetermined angle causes the projection to disengage from the spur thereby allowing the first trigger to pivot about the first trigger axis.

In an example embodiment a boss extends from the second trigger at a point thereon distal to the second trigger axis. A hook is positioned on the safety lever. The hook is engageable with the boss to prevent pivoting of the second trigger about the second trigger axis. Pivoting motion of the safety lever though a second predetermined angle causes the hook to disengage from the boss, thereby allowing the second trigger to pivot about the second trigger axis. In an example embodiment, the second predetermined angle equals the first predetermined angle.

An example embodiment may further comprise first and second side plates in spaced apart relation. The first trigger, the sear connector and the sear are pivotably mounted between the first and second side plates.

In an example embodiment, a first spring biases the first trigger such that the action surface engages the engagement surface of the sear connector, and a second spring biasing the sear connector such that the first side of the sear connector engages the sear.

The invention also encompasses a firearm. In an example embodiment, the firearm comprises a receiver. A bolt is mounted on the receiver and is movable between an open position and a closed position. A firing pin is positioned within the bolt. The firing pin is movable within the bolt between a cocked and a released position. A spring is within the bolt biasing the firing pin into the released position. A trigger mechanism is positioned within the receiver. By way of example the trigger mechanism comprises a first trigger pivotable about a first trigger axis. The first trigger has an action surface positioned distal to the first trigger axis. A sear connector is pivotable about a sear connector axis. The sear connector has an engagement surface positioned distal to the sear connector axis. The action surface is engageable with the engagement surface to prevent pivoting motion of the sear connector. A sear is pivotable about a sear axis. The sear has a contact surface engageable with a first side of the sear connector between the engagement surface and the sear connector axis. The sear has a face engageable with the firing pin for holding the firing pin in the cocked position. A second trigger is pivotable about a second trigger axis extending through the first trigger. The second trigger has a lobe distal to the second trigger axis. The lobe is engageable with a second side of the sear connector arranged opposite to the first side and between the engagement surface and the sear connector axis to prevent pivoting motion of the sear connector. Pivoting motion of the second trigger through a predetermined angle causes the lobe to disengage from the second side of the sear connector, thereby allowing the sear connector to pivot when the first trigger is pivoted to disengage the action surface from the engagement surface, thereby permitting the sear to pivot about the sear axis and disengage the face from the firing pin thereby allowing the firing pin to move from the cocked to the released position.

In an example embodiment the second side of the sear connector has a concave surface. By way of example, the concave surface has a radius of curvature equal to a distance of the lobe from the second trigger axis and the second trigger axis is coincident with a center of curvature of the concave surface.

An example further comprises a spur extending from the first trigger. A safety lever is mounted adjacent to the first trigger and is pivotable about a lever axis. A projection extends from the safety lever and is positioned distal to the lever axis. The projection is engageable with the spur to prevent pivoting motion of the first trigger. Pivoting of the safety lever through a first predetermined angle causes the projection to disengage from the spur thereby allowing the first trigger to pivot about the first trigger axis.

An example embodiment further comprises a boss extending from the second trigger at a point thereon distal to the second trigger axis. A hook is positioned on the safety lever. The hook is engageable with the boss to prevent pivoting of the second trigger about the second trigger axis. Pivoting motion of the safety lever though a second predetermined angle causes the hook to disengage from the boss, thereby allowing the second trigger to pivot about the second trigger axis. In an example embodiment the second predetermined angle equals the first predetermined angle.

An example embodiment may further comprise first and second side plates in spaced apart relation. The first trigger, the sear connector and the sear are pivotably mounted between the first and second side plates. An example firearm may further comprise a first spring biasing the first trigger such that the action surface engages the engagement surface of the sear connector. Also by way of example, a second spring may bias the sear connector such that the first side of the sear connector engages the sear. Further comprising a cocking piece attached to the firing pin, the sear engaging the firing pin through the cocking piece.

DETAILED DESCRIPTION

Figure 1:
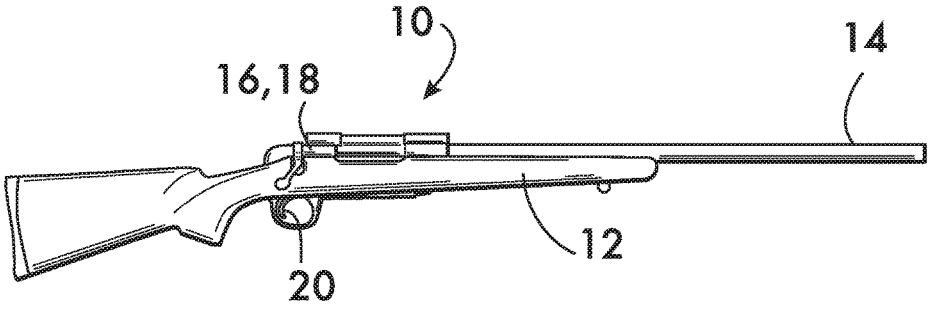
FIG. 1 is a right side view of an example rifle having a trigger mechanism according to the invention.
Figure 2:
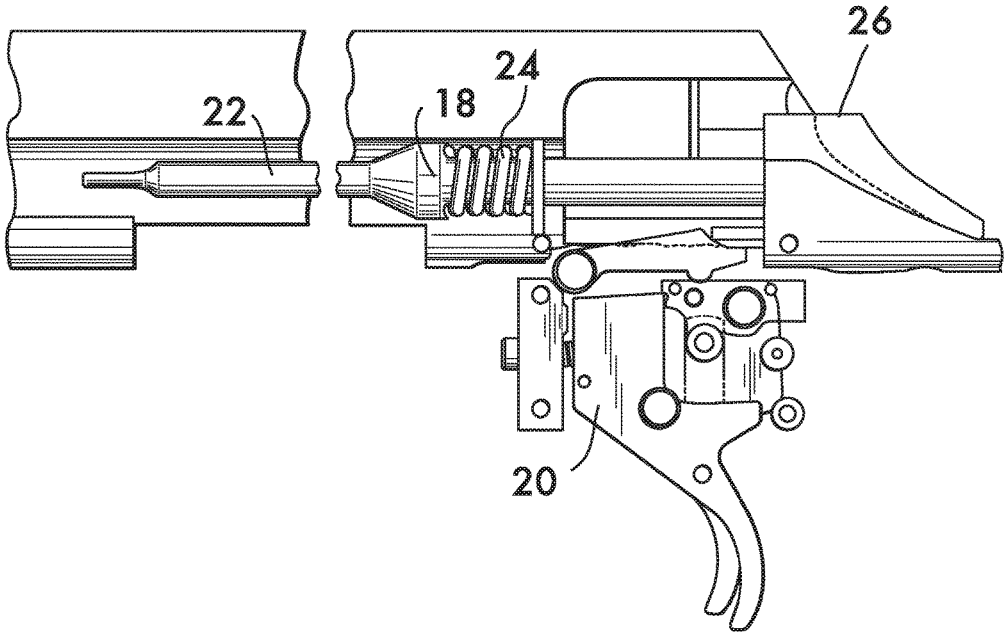
FIG. 2 is a partial sectional view of an example action and trigger mechanism according to the invention.

FIG. 1 shows a firearm, in this example a bolt action rifle 10. Rifle 10 comprises a stock 12 on which are mounted a barrel 14 and a receiver 16. Receiver 16 houses an action, in this example a bolt action 18 and a trigger mechanism 20. FIG. 2 shows the action 18 and trigger mechanism 20 in detail. A firing pin 22 is positioned within the bolt 18. Firing pin 22 is movable relatively to the bolt 18 between a cocked position (shown) and a released position. The firing pin 22 is biased into the released position by a spring 24 within the bolt 18. In this example a cocking piece 26 is attached to the firing pin 22, the cocking piece providing the interface between the firing pin and the trigger mechanism 20 as described below.

Figure 3:
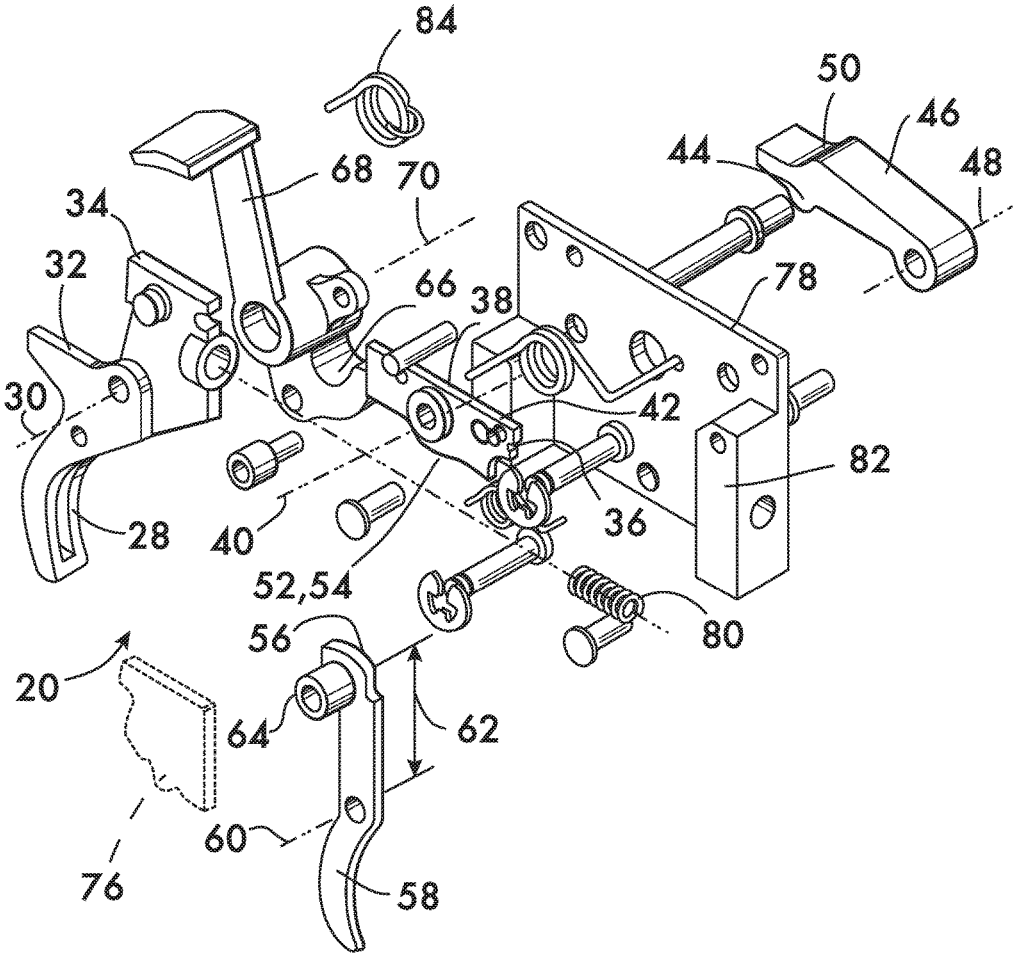
FIG. 3 is an exploded isometric view of an example trigger mechanism according to the invention.
Figure 7:
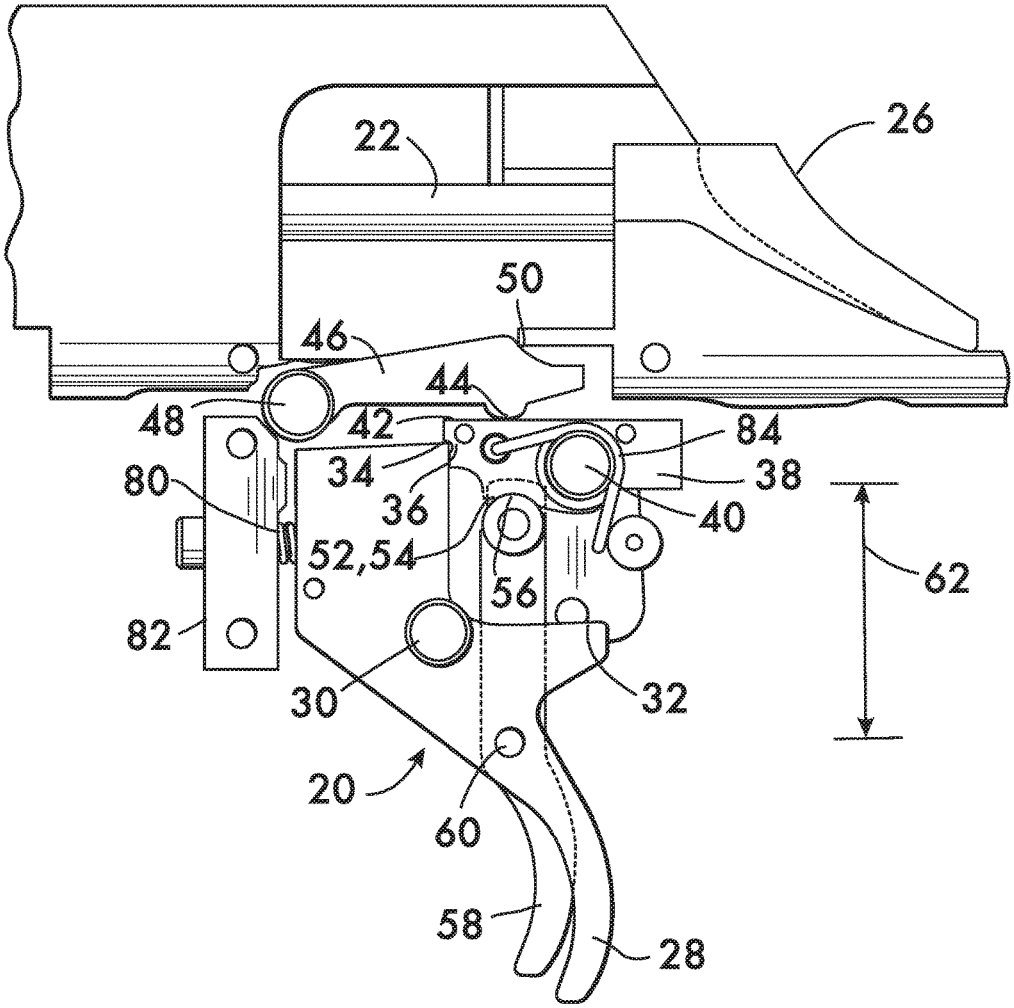
FIGS. 7 and 8 are partial section views of the action and trigger mechanism shown in FIGS. 2 and 3 illustration operation of the example trigger mechanism according to the invention.

FIGS. 3 and 7 show the trigger mechanism 20 in detail. In this example, mechanism 20 comprises a first trigger 28 pivotable about a first trigger axis 30. First trigger 28 has a spur 32 extending outwardly therefrom and an action surface 34 positioned distal to the trigger axis 30. Action surface 34 engages an engagement surface 36 on a sear connector 38. Sear connector 38 is pivotable about a sear connector axis 40, the engagement surface 36 being positioned on the sear connector 38 distal to the axis 40. A first side 42 of the sear connector 38 is engageble with a contact surface 44 of a sear 46. Sear 46 is pivotable about a sear axis 48. Engagement between the contact surface 44 and the first side 42 of the sear connector 38 is at a point between engagement surface 36 and the sear connector axis 40. Sear 46 has a face 50 engageable with the firing pin 22. In this example, engagement of the face 50 and the firing pin 22 is via the cocking piece 26 attached to the firing pin.

Sear connector 38 also has a second side 52 arranged opposite to the first side 42. Advantageously, the second side 52 may have a concave surface 54. The second side 52 of sear connector 38 is engageable with a lobe 56 of a second trigger 58 (see FIG. 7). Second trigger 58 is pivotable about a second trigger axis 60 which extends through the first trigger 28. Lobe 56 is positioned distal to the second trigger axis 60, the distance 62 between the axis and the end of the lobe being equal to the radius of curvature of the concave surface 54 of the second side 52 of the sear connector 38. The second trigger axis 60 is furthermore positioned coincident with the center of curvature of the second side 52. This geometrical relation between the second trigger 58 and the concave surface 54 of the second side 52 allows the second trigger 58 to pivot about the second trigger axis 60 on an arc that corresponds to the radius of curvature of the concave surface 54 and thereby maintain contact with second side 52 to effectively block release of the sear connector 38 as long as there is contact between the lobe 56 and the surface 54. In a practical example the second trigger 58 can pivot 10° while maintaining reliable contact between the lobe 56 and the surface 54. The pivot angle is meaningful with respect to timing and cooperation between the second trigger 58 and the safety, as described below. If surface 54 were not concave, then small movements of the sear connector 38 would be possible even during engagement between lobe 56 and surface 54. This condition might allow release of the bolt under an inertial force even with the lobe 56 and surface 54 in contact. The geometrical relation also allows the second trigger 58 to pivot without moving the sear connector 38 and without encountering any significant resistance, as might occur if the second side 52 were straight.

Figure 4:
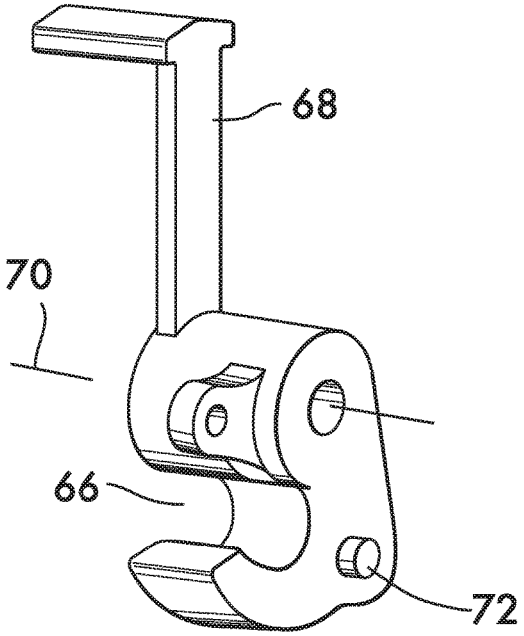
FIG. 4 is an isometric view of an example safety lever used in the trigger mechanism of FIG. 3.
Figure 5:
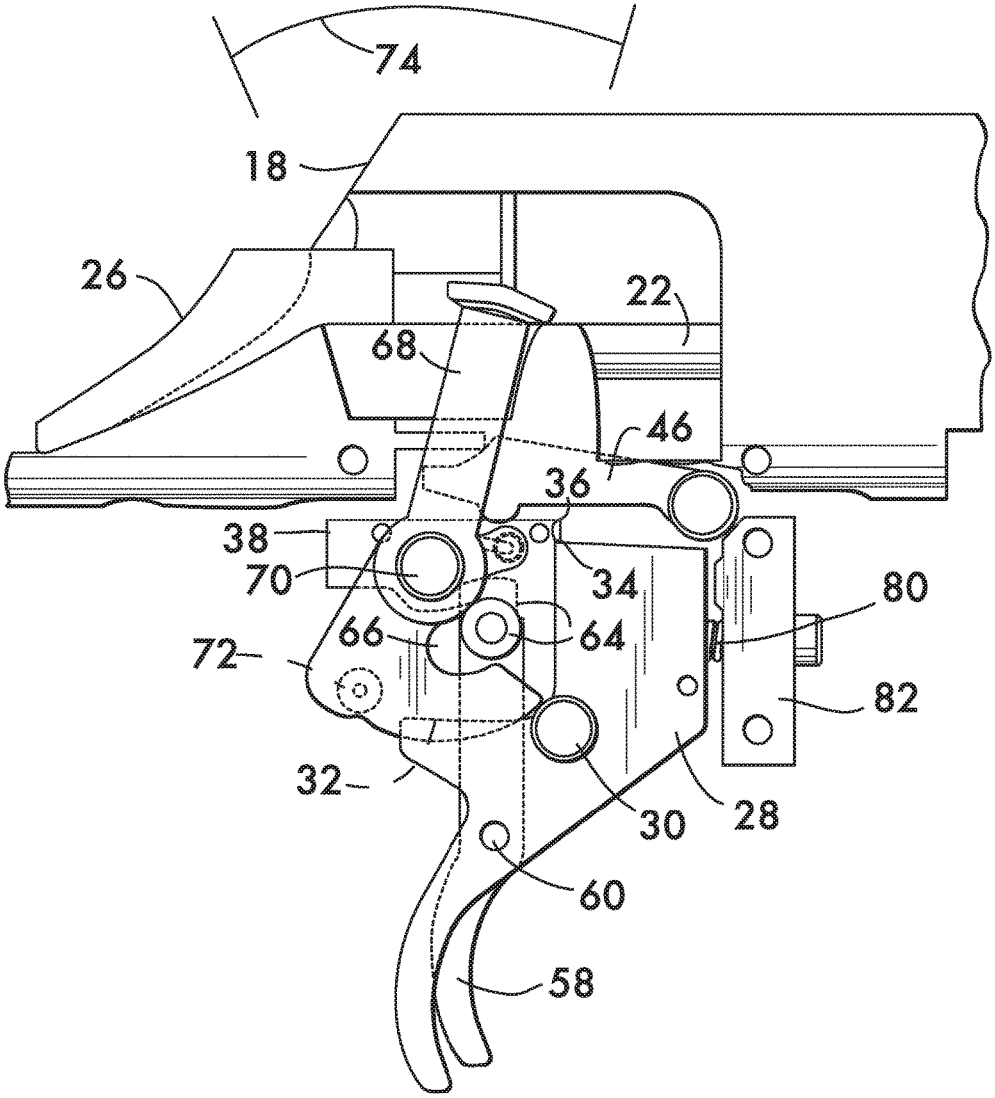
FIGS. 5 and 6 are partial sectional views of the action and trigger mechanism shown in FIGS. 2 and 3 illustrating operation of the example safety lever shown in FIG. 4.

As shown in FIG. 3, a boss 64 extends from the second trigger 58 at a point distal to the second trigger axis 60. Boss 64 is engageable with a hook 66 positioned on a safety lever 68. Safety lever 68 is positioned adjacent to the first trigger 28 and is pivotable about a lever axis 70. As shown in FIG. 4, a projection 72 extends from safety lever 68, the projection being positioned distal to the lever axis 70. Hook 66 and projection 72 permit the safety lever 68 to simultaneously engage both the first and second triggers 28 and 58 and prevent inadvertent discharge of the firearm. FIG. 5 shows the trigger mechanism 20 with the safety lever 68 in the "fire" position (safety off). When lever 68 is in the "fire" position the hook 66 does not engage the boss 64 of the second trigger 58 and the projection 72 does not engage the spur 32 of the first trigger 28. When lever 68 is in the "fire" position the triggers 28 and 58 may be pulled to fire the firearm as described below.

Figure 6:
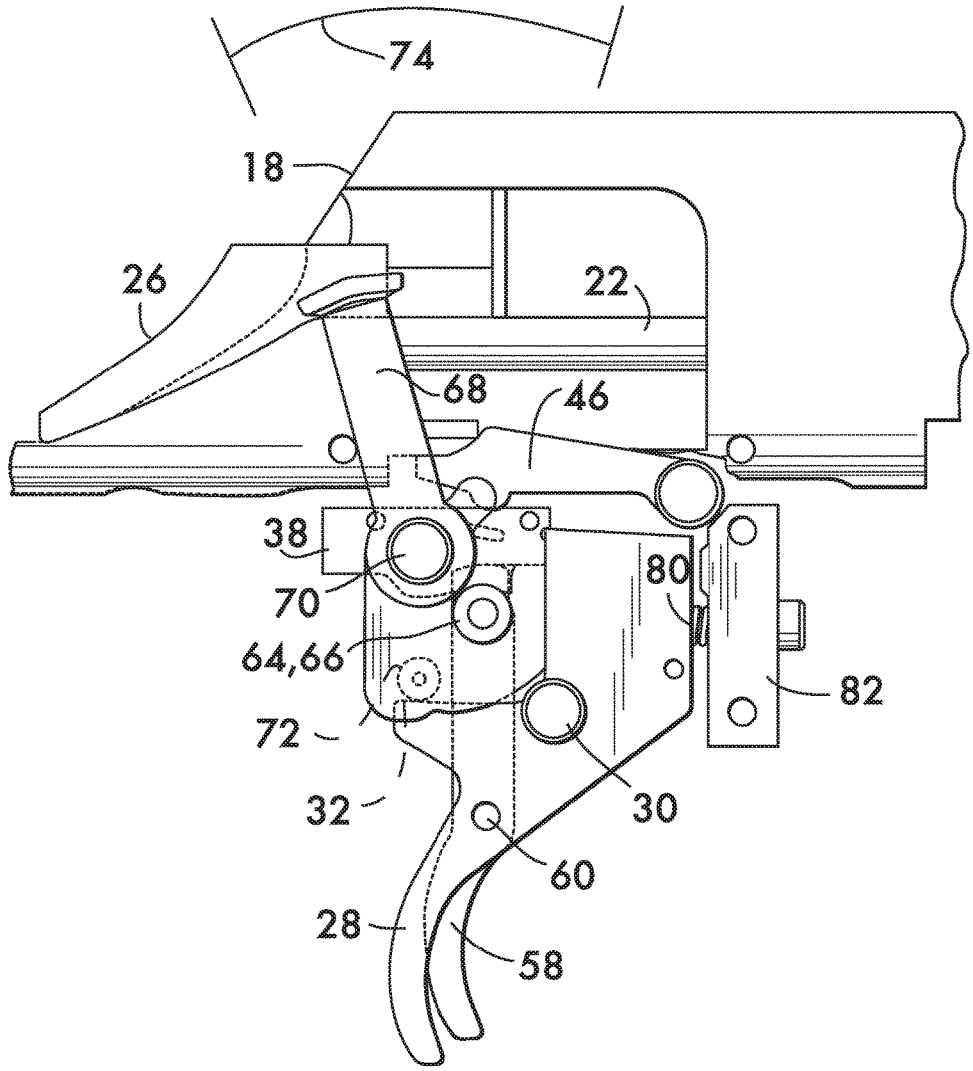

FIG. 6 shows the trigger mechanism 20 with the safety lever 68 in the "safe" position. With lever 68 in the "safe" position, the hook 66 engages the boss 64 and prevents pivoting motion of the second trigger 58. If the second trigger 58 cannot pivot then lobe 56 remains engaged with the second side 52 of the sear connector 38 (see FIG. 7), preventing it from pivoting, which, in turn, prevents the sear 46 from pivoting and releasing the firing pin 22. Engagement between the safety lever 68 and the second trigger 58 safeguards against inadvertent discharge because even if the action surface 34 of the first trigger 28 disengages from the engagement surface 34 of the sear connector 38, for example, under inertial loads on the first trigger 28 resulting from the firearm being dropped, the second trigger 58 continues to support the sear connector 38 which prevents motion of the sear 46.

With safety lever 68 in the "safe" position the projection 72 engages the spur 32 of the first trigger 28. This engagement prevents pivoting of the first trigger 28 and keeps the action surface 34 engaged with the engagement surface 36 of the sear connector 38, thereby preventing the sear connector from pivoting, which, in turn prevents the sear 46 from moving and releasing the firing pin 22. The safety lever 68 may be moved to the "fire" position by pivoting it (clockwise in FIG. 5) about its lever axis 70 through a predetermined angle 74 which disengages the hook 66 from the boss 64 of the second trigger 58 and disengages the projection 72 from the spur 32 of the first trigger 28. It is advantageous to arrange the geometry of the various parts so that the predetermined angle 74 is the same for disengagement of both the hook 66 from the boss 64 and the projection 72 from the spur 32. It is also feasible to arrange the components such that disengagement of the hook from the boss occurs at a first predetermined angle, and disengagement of the projection from the spur occurs at a second predetermined angle, different from the first angle.

Figure 8:
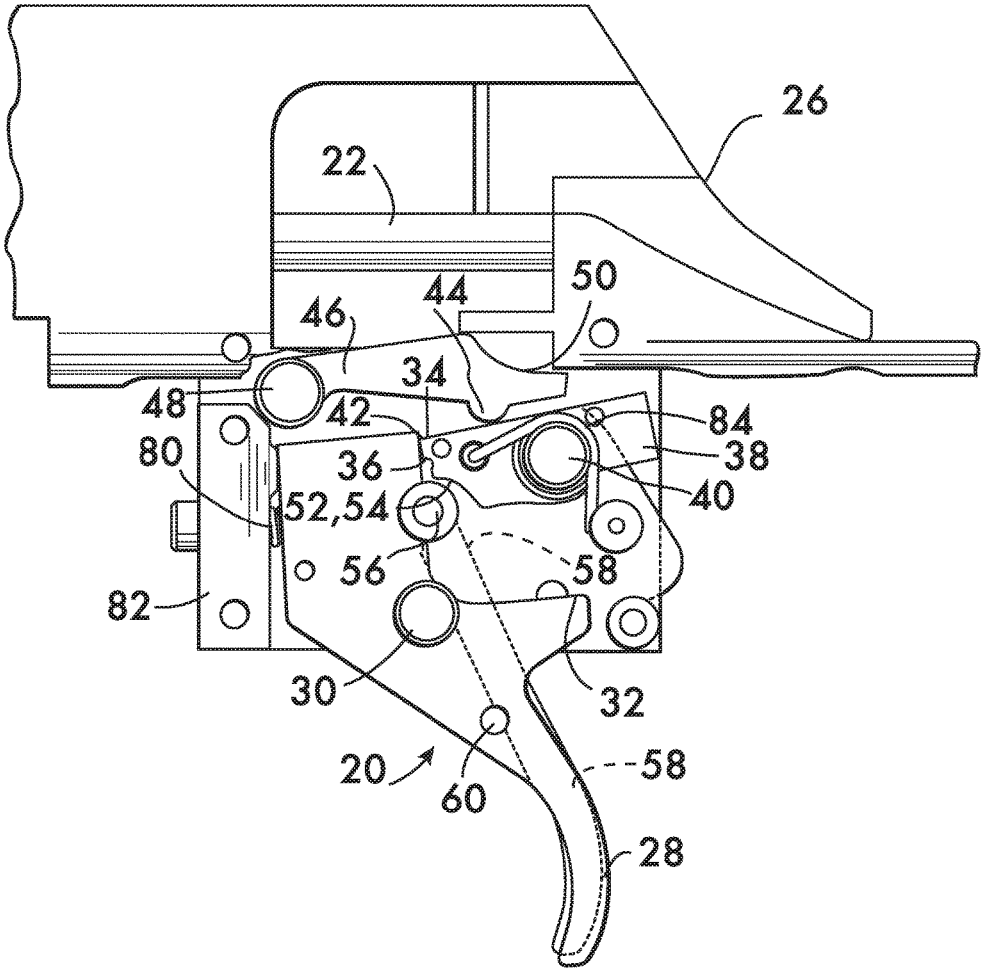

FIGS. 7 and 8 illustrate operation of the trigger mechanism 20 to discharge firearm 10. As shown in FIG. 7, the safety lever 68 is pivoted to the "fire" position and the firing pin 22 (and its associated cocking piece 26) are in the "cocked" configuration (spring 24 compressed, firing pin held cocked by the sear 46). With its lobe 56 engaging the concave surface 54 of the second side 52 of the sear connector 38 the second trigger 58 now acts as a safety to prevent accidental discharge if the firearm 10 is subjected to inertial forces. The second trigger 58 is then pulled, pivoting it about the second trigger axis 60. The lobe 56 stays in contact with the concave surface 54 as it sweeps through an arc centered on trigger axis 60. Lobe 56 disengages from the second side at the end of its motion, for example, after pivoting 10°. Sear connector 38 is now free to pivot about its axis 48. The first trigger 28 is pulled and pivots about the first trigger axis 30, which causes the engagement surface 36 of the sear connector 38 to fall off of the action surface 34 of the first trigger 28 (see FIG. 8). With the sear connector 38 no longer supported by the first trigger 28, the sear connector is free to pivot and cannot support the sear 46. Thus, force exerted on the sear 46 by the cocked firing pin spring 24 through the cocking piece 26 causes the sear 46 to pivot, which releases the firing pin 22. The firing pin 22 moves under the biasing force of spring 24 to strike a primer or the rim of a chambered cartridge (not shown) to discharge the firearm 10.

In a practical design of a trigger mechanism 20, it is advantageous to mount the components such as the first trigger 28, the sear connector 38, the sear 46 and the safety lever 68 on respective pivot pins supported by first and second side plates 76 and 78 arranged in spaced apart relation within the receiver 16 (see FIG. 3). It is further advantageous to bias the first trigger 28 such that its action surface 34 engages the engagement surface 36 of the sear connector 38. In this example the first trigger 28 is biased by spring 80 acting between a spacer 82 mounted between the side plates 76 and 78. It is also advantageous to bias the sear connector 38 into engagement with the sear 46. In this example a coil spring 84 biases the sear connector 38 (FIGS. 7 and 8).

It is expected that use of the second trigger 58 in conjunction with the sear connector 38 will help prevent inadvertent firearm discharge due, for example, to inertial forces induced on the trigger mechanism when the firearm is dropped.

What is claimed is:

1. A trigger mechanism for a firearm, said trigger mechanism comprising:

a first trigger pivotable about a first trigger axis, said first trigger having an action surface positioned distal to said first trigger axis;

a sear connector pivotable about a sear connector axis, said sear connector having an engagement surface positioned distal to said sear connector axis, said action surface being engageable with said engagement surface to prevent pivoting motion of said sear connector;

a sear pivotable about a sear axis, said sear having a contact surface engageable with a first side of said sear connector between said engagement surface and said sear connector axis;

a second trigger pivotable about a second trigger axis extending through said first trigger, said second trigger having a lobe distal to said second trigger axis, said lobe being engageable with a second side of said sear connector arranged opposite to said first side and between said engagement surface and said sear connector axis to prevent pivoting motion of said sear connector; wherein pivoting motion of said second trigger through a predetermined angle causes said lobe to disengage from said second side of said sear connector, thereby allowing said sear connector to pivot when said first trigger is pivoted to disengage said action surface from said engagement surface, thereby permitting said sear to pivot about said sear axis.

2. The mechanism according to claim 1, wherein said second side of said sear connector has a concave surface.

3. The mechanism according to claim 2, wherein said concave surface has a radius of curvature equal to a distance of said lobe from said second trigger axis and said second trigger axis is coincident with a center of curvature of said concave surface.

4. The mechanism according to claim 1, further comprising:

a spur extending from said first trigger;

a safety lever mounted adjacent to said first trigger and pivotable about a lever axis;

a projection extending from said safety lever and positioned distal to said lever axis, said projection being engageable with said spur to prevent pivoting motion of said first trigger; wherein pivoting of said safety lever through a first predetermined angle causes said projection to disengage from said spur thereby allowing said first trigger to pivot about said first trigger axis.

5. The mechanism according to claim 4, further comprising:

a boss extending from said second trigger at a point thereon distal to said second trigger axis;

a hook positioned on said safety lever, said hook being engageable with said boss to prevent pivoting of said second trigger about said second trigger axis; wherein pivoting motion of said safety lever though a second predetermined angle causes said hook to disengage from said boss thereby allowing said second trigger to pivot about said second trigger axis.

6. The mechanism according to claim 5, wherein said second predetermined angle equals said first predetermined angle.

7. The mechanism according to claim 1, further comprising:

a boss extending from said second trigger at a point thereon distal to said second trigger axis;

a hook positioned on said safety lever, said hook being engageable with said boss to prevent pivoting of said second trigger about said second trigger axis; wherein pivoting motion of said safety lever though a first predetermined angle causes said hook to disengage from said boss thereby allowing said second trigger to pivot about said second trigger axis.

8. The mechanism according to claim 7, further comprising:

a spur extending from said first trigger;

a safety lever mounted adjacent to said first trigger and pivotable about a lever axis;

a projection extending from said safety lever and positioned distal to said lever axis, said projection being engageable with said spur to prevent pivoting motion of said first trigger; wherein pivoting of said safety lever through a second predetermined angle causes said projection to disengage from said spur thereby allowing said first trigger to pivot about said first trigger axis.

9. The mechanism according to claim 8, wherein said second predetermined angle equals said first predetermined angle.

10. The mechanism according to claim 1, further comprising first and second side plates in spaced apart relation, said first trigger, said sear connector and said sear being pivotably mounted between said first and second side plates.

11. The mechanism according to claim 1, further comprising:

a first spring biasing said first trigger such that said action surface engages said engagement surface of said sear connector; and a second spring biasing said sear connector such that said first side of said sear connector engages said sear.

12. A firearm, said firearm comprising:

a receiver;

a bolt mounted on said receiver and movable between an open position and a closed position;

a firing pin positioned within said bolt, said firing pin being movable within said bolt between a cocked and a released position;

a spring within said bolt biasing said firing pin into said released position;

a trigger mechanism positioned within said receiver, said trigger mechanism comprising:

a first trigger pivotable about a first trigger axis, said first trigger having an action surface positioned distal to said first trigger axis;

a sear connector pivotable about a sear connector axis, said sear connector having an engagement surface positioned distal to said sear connector axis, said action surface being engageable with said engagement surface to prevent pivoting motion of said sear connector;

a sear pivotable about a sear axis, said sear having a contact surface engageable with a first side of said sear connector between said engagement surface and said sear connector axis, said sear having a face engageable with said firing pin for holding said firing pin in said cocked position;

a second trigger pivotable about a second trigger axis extending through said first trigger, said second trigger having a lobe distal to said second trigger axis, said lobe being engageable with a second side of said sear connector arranged opposite to said first side and between said engagement surface and said sear connector axis to prevent pivoting motion of said sear connector; wherein pivoting motion of said second trigger through a predetermined angle causes said lobe to disengage from said second side of said sear connector, thereby allowing said sear connector to pivot when said first trigger is pivoted to disengage said action surface from said engagement surface, thereby permitting said sear to pivot about said sear axis and disengage said face from said firing pin thereby allowing said firing pin to move from said cocked to said released position.

13. The firearm according to claim 12, wherein said second side of said sear connector has a concave surface.

14. The firearm according to claim 13, wherein said concave surface has a radius of curvature equal to a distance of said lobe from said second trigger axis and said second trigger axis is coincident with a center of curvature of said concave surface.

15. The firearm according to claim 12, further comprising:

a spur extending from said first trigger;

a safety lever mounted adjacent to said first trigger and pivotable about a lever axis;

a projection extending from said safety lever and positioned distal to said lever axis, said projection being engageable with said spur to prevent pivoting motion of said first trigger; wherein pivoting of said safety lever through a first predetermined angle causes said projection to disengage from said spur thereby allowing said first trigger to pivot about said first trigger axis.

16. The firearm according to claim 15, further comprising:

a boss extending from said second trigger at a point thereon distal to said second trigger axis;

a hook positioned on said safety lever, said hook being engageable with said boss to prevent pivoting of said second trigger about said second trigger axis; wherein pivoting motion of said safety lever though a second predetermined angle causes said hook to disengage from said boss thereby allowing said second trigger to pivot about said second trigger axis.

17. The firearm according to claim 16, wherein said second predetermined angle equals said first predetermined angle.

18. The firearm according to claim 12, further comprising:

a boss extending from said second trigger at a point thereon distal to said second trigger axis;

a hook positioned on said safety lever, said hook being engageable with said boss to prevent pivoting of said second trigger about said second trigger axis; wherein pivoting motion of said safety lever though a first predetermined angle causes said hook to disengage from said boss thereby allowing said second trigger to pivot about said second trigger axis.

19. The firearm according to claim 18, further comprising:

a spur extending from said first trigger;

a safety lever mounted adjacent to said first trigger and pivotable about a lever axis;

a projection extending from said safety lever and positioned distal to said lever axis, said projection being engageable with said spur to prevent pivoting motion of said first trigger; wherein pivoting of said safety lever through a second predetermined angle causes said projection to disengage from said spur thereby allowing said first trigger to pivot about said first trigger axis.

20. The firearm according to claim 19, wherein said second predetermined angle equals said first predetermined angle.

21. The firearm according to claim 12, further comprising first and second side plates in spaced apart relation, said first trigger, said sear connector and said sear being pivotably mounted between said first and second side plates.

22. The firearm according to claim 12, further comprising:

a first spring biasing said first trigger such that said action surface engages said engagement surface of said sear connector; and a second spring biasing said sear connector such that said first side of said sear connector engages said sear.

23. The firearm according to claim 12, further comprising a cocking piece attached to said firing pin, said sear engaging said firing pin through said cocking piece.

* * * * *